US005975039A

United States Patent [19]

Oshige

[11] Patent Number: 5,975,039

[45] Date of Patent: Nov. 2, 1999

[54] PROCESS FOR MANUFACTURING VALVE SEAT MADE OF SINTERED FE ALLOY AND VALVE SEAT MADE OF SINTERED FE ALLOY

[75] Inventor: Hiroshi Oshige, Shimotsuga-gun, Japan

[73] Assignee: Nippon Piston Ring Co., Ltd., Japan

[21] Appl. No.: 08/998,628

[22] Filed: Dec. 29, 1997

[30] Foreign Application Priority Data

Dec. 27, 1996 [JP] Japan ..... 8-358148

[51] Int. Cl.[6] ..... B22F 5/00; B22F 7/02

[52] U.S. Cl. ..... 123/188.8; 123/188.3; 29/888.4; 75/246; 419/6

[58] Field of Search ..... 123/188.3, 188.8; 75/246; 29/888.4, 888.44; 419/6

[56] References Cited

U.S. PATENT DOCUMENTS

| | | | |
|---|---|---|---|
| 4,485,147 | 11/1984 | Nishino et al. | 428/550 |
| 4,546,737 | 10/1985 | Kazuoka et al. . | |
| 4,671,491 | 6/1987 | Kuroishi et al. | 251/368 |
| 4,724,000 | 2/1988 | Larson et al. . | |
| 4,734,968 | 4/1988 | Kuroishi et al. | 419/27 |
| 5,080,713 | 1/1992 | Ishibashi et al. | 75/246 |
| 5,158,601 | 10/1992 | Fujiki et al. | 75/246 |
| 5,666,632 | 9/1997 | Maulik | 419/6 |
| 5,777,247 | 7/1998 | Garg et al. | 75/246 |

FOREIGN PATENT DOCUMENTS

| | | |
|---|---|---|
| 2 313 900 | 12/1997 | United Kingdom . |
| WO 94/27767 | 12/1994 | WIPO . |

*Primary Examiner*—Henry C. Yuen
*Assistant Examiner*—Hai Huynh
*Attorney, Agent, or Firm*—Nixon & Vanderhye

[57] ABSTRACT

A process for manufacturing a valve seat which is made of a sintered Fe alloy and comprises a main layer of a valve seat and a contacting layer, comprises the steps of preparing either a powdery Cu or a powdery material containing Cu in a powdery Fe alloy, forming a green compact body with two green compact body layers, one of which is the main layer and the other of which is the contacting layer, and which are made of the prepared powdery Fe alloy containing Cu, sintering the green compact body. According to the present invention, the infiltration of Cu from the main layer to the contacting layer of the valve seat is not generated as the conventional sintering process for manufacturing the valve seat comprising the two layers without the independent infiltration treatment of Cu, and, therefore, the valve seat obtained of the present invention has an high abrasion resistance without decreasing of a strength of the main layer.

1 Claim, 5 Drawing Sheets

PROCESS FOR MANUFACTURING VALVE SEAT MADE OF SINTERED FE ALLOY AND VALVE SEAT MADE OF SINTERED FE ALLOY

BACKGROUND OF THE INVENTION

The present invention relates to a process for manufacturing a valve seat which may suitably be used for an internal combustion engine, made of a sintered Fe alloy and to a valve seat made of a sintered Fe alloy, and more specifically to the process for manufacturing the valve seat and the valve seat wherein the valve seat comprises a contacting layer abutting against a valve and a main layer supporting the contacting layer.

A valve seat has a conical surface portion to which a valve is abutted and is a component part of an internal combustion engine. The valve seat is formed by processing of a cylinder material or a cylinder head casting material and by fit of a ring formed beforehand. In either case, the valve seat is required to improve a thermal conductivity, lubrication property and a strength at a high temperature.

Hitherto, there has generally been used the valve seat to which an infiltration treatment of Cu is performed into a sintered Fe alloy in order to solve the problem described above. As a process for manufacturing the conventional valve seat, for example, a valve seat without including both Cu and Pb is sintered by a normal sintering method in the first place, and the valve seat with both Cu and Pb is so obtained that holes in the sintered Fe alloy is infiltrated by either Cu or Pb in the final place. Thus, the thermal conductivity, the lubrication property and the strength at a high temperature thereof have been improved.

However, there is a problem that the manufacturing cost of the valve seat made of the sintered Fe alloy with either infiltrated Cu or infiltrated Pb becomes high because the infiltration treatment is needed in addition to the sintered treatment.

In view of the above-mentioned circumstances, there is known from Japanese Patent Publication No. 2-35125 a process for manufacturing a valve seat with two green compact body layers made of a sintered Fe alloy to provide the valve seat which has the same property as the conventional valve seat and is cheap to manufacture. The valve seat described above is obtained by the step of formation of a green compact body comprising two green compact body layers in which one green compact body layer is a main layer with either Cu or Pb and the other green compact body layer is a contacting layer without both Cu and Pb, and by the next step of sintering of the green compact body. According to the process described above, the property of the contacting layer which is contacted to the valve, can be improved by infiltration of either Cu or Pb from the main layer to the contacting layer at the same time of the sintering process without the independent infiltration treatment of both Cu and Pb.

The process described above has an excellent property because the contacting layer after the sintering process becomes the infiltrated layer of either Cu or Pb without the porosity which exists in the layer before the sintering process. The infiltration by capillarity of either Cu or Pb is carried out from the main layer to holes in the contacting layer at the same time of the sintering process. However, the process has a problem that holes are generated in the main layer by the infiltration of either Cu or Pb, so that a strength of the main layer decreases, and a whole strength of the valve seat also decreases.

And, Pb may give a bad influence to the environment.

SUMMARY OF THE INVENTION

The present invention was made in view of the above-mentioned circumstances. An object of the present invention is therefore to provide a process for manufacturing a valve seat made of a sintered Fe alloy and to provide a valve seat made of a sintered Fe alloy, which has a high strength and an excellent abrasion resistance, wherein the valve seat is made up by two layers with a main layer and a contacting layer, and moreover, the valve seat obtained can be used for a valve seat provided in a high function internal combustion engine.

For the purpose of attainment of the aforementioned object of the present invention, a process for manufacturing a valve seat which is made of a sintered Fe alloy and comprises a main layer and a contacting layer, comprises the step of preparation of either a powdery Cu or a powdery material containing Cu in a powdery Fe alloy, the step of formation of a green compact body with two green compact body layers, one of which is the main layer and the other of which is the contacting layer, and which are made of the prepared powdery Fe alloy containing Cu, and the step of sintering of the green compact body.

A valve seat, which comprises a main layer of a valve seat and a contacting layer of a valve seat and is made of a sintered Fe alloy, is formed by a process in the manner comprising the step of preparation of either a powdery Cu or a powdery material containing Cu in a powdery Fe alloy, the step of formation a green compact body with two green compact body layers, one of which is the main layer and the other of which is the contacting layer, and which are made of the prepared powdery Fe alloy containing Cu, and the step of sintering of the green compact body, and wherein the contacting layer contains Cu from 3 wt. % to 20 wt. %, and the main layer contains Cu from 5 wt. % to 25 wt. %.

In the above-mentioned valve seat made of the sintered Fe alloy, a difference of Cu content between the contacting layer and the main layer in the valve seat is 5 wt. % or below is preferable.

As the process for manufacturing the valve seat of the present invention, the powdery Cu or the powdery material containing Cu is previously added to the powdery raw material for the contacting layer and the main layer of the valve seat, and the green compact body with two green compact body layers is formed by the prepared powdery Fe alloy described above, so that it is not necessary to perform the infiltration treatment of Cu into the green compact body. Furthermore, the infiltration of Cu from the main layer to the contacting layer is not generated as the conventional sintering process for manufacturing the valve seat comprising the two layers without the independent infiltration treatment of Cu, and, therefore, the change of the density of each layer of the valve seat is small and the strength of the main layer is not dropped.

DESCRIPTION OF THE PREFERRED EMBODIMENTS

Figure 1:
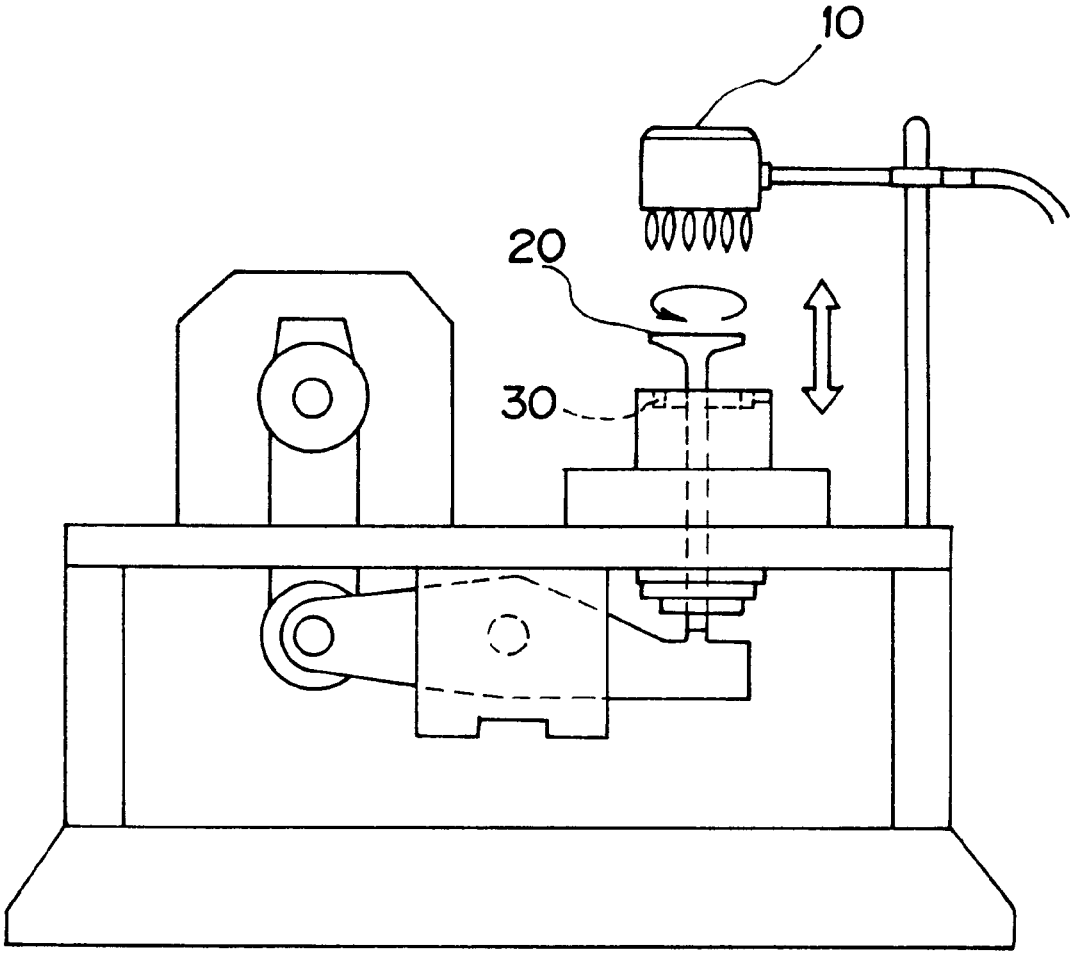
FIG. 1 is a schematic view illustrating an abrasion testing apparatus to be used in Experiment Examples and Comparative Examples as described hereinafter.

Now, a process of the present invention for manufacturing a valve seat made of a sintered Fe alloy and a valve seat of the present invention made of a sintered Fe alloy will be described above in detail below.

In the process of the present invention for manufacturing the valve seat and the valve seat of the present invention, two powdery raw materials for sintering a contacting layer of the valve seat and for a main layer of the valve seat are prepared in such a manner that either a powdery Cu or a powdery material containing a powdery Cu and a other necessary powdery material are added at a predetermined ratio to a powdery Fe as a main component. And, the respective prepared powdery Fe alloy for sintering is so obtained that a lubricant or the like is added to two powdery raw materials described above. After that, the respective prepared powdery alloy described above are used for the contacting layer and the main layer, and one green compact body made of the prepared powdery Fe alloy for the contacting layer and the other green compact body made of the prepared powdery Fe alloy for the main layer are subjected to a press forming process to form the green compact body of the valve seat, and thereafter, a dewaxing treatment, a sintering treatment and an tempering treatment are performed in this order. Thus, the valve seat of the present invention can be obtained by process described above.

A powdery electrodeposited Cu or the like is used as the powdery Cu or the powdery material containing the powdery Cu and is added to the powdery raw material to improve a thermal conductivity and a strength at a high temperature. The Cu content is preferably from 3 wt. % to 20 wt. % in the prepared powdery Fe alloy for the contacting layer and from 5 wt. % to 25 wt. % in the prepared powdery Fe alloy for the main layer, and more preferably from 7 wt. % to 15 wt. % in the prepared powdery Fe alloy for the contacting layer and from 8 wt. % to 18 wt. % in the prepared powdery Fe alloy for the main layer.

With either the Cu contents of under 3 wt. % in the prepared powdery Fe alloy for the contacting layer of the valve seat or of under 5 wt. % in the prepared powdery Fe alloy for the main layer of the valve seat, even if the Cu content of one layer which is the contacting layer or the main layer, is in the preferable range described above, the valve seat generates large holes in a metallurgical structure whereby a Cu component markedly moves from one layer with the preferable range of the Cu content to the other layer without the preferably range of the Cu content because the Cu component is completely solved in the other layer. Thus, the thermal conductivity, the strength and the like may not be sufficiently improved.

With either the Cu contents of over 20 wt. % in the prepared powdery Fe alloy for the contacting layer of the valve seat or of over 25 wt. % in the prepared powdery Fe alloy for the main layer of the valve seat, even if the Cu content of one layer which is the contacting layer or the main layer, is in the preferable range described above, the valve seat generates a large phase of Cu so that the abrasion resistance and the precision of dimension of the valve seat obtained may not be sufficiently improved.

With both the Cu content of under 3 wt. % in the prepared powdery Fe alloy for the contacting layer of the valve seat and of under 5 wt. % in the prepared powdery Fe alloy for the main layer of the valve seat, the thermal conductivity may not be sufficiently improved because the Cu phase is not left in the metallurgical structure of the valve seat.

With both the Cu contents of over 20 wt. % in the prepared powdery Fe alloy for the contacting layer of the valve seat and of over 25 wt. % in the prepared powdery Fe alloy for the main layer of the valve seat, the strength and the abrasion resistance may not be sufficiently improved because an amount of a residual Cu in the valve seat is too much after a sintering process.

Furthermore, a difference of the Cu content between the prepared powdery Fe alloy for the contacting layer and the prepared powdery Fe alloy for the main layer is preferably 5 wt. % or below. With the difference of over 5 wt. %, the infiltration of Cu occurs from one layer which is either the contacting layer or the main layer to the other layer, so that the property of the valve seat obtained changes, for example, the strength of the valve seat lowers because of the decrease of a relative density.

As a necessary powdery material, the powdery material of C (graphite), Cr, Mo, Ni, Co and the like or the powdery material containing those component can be suitably used for the powdery raw material. The powdery C described above is added to the powdery raw material to maintain a sintering property and the strength of the valve seat, and the powdery Cr, Mo, Ni, Co or the like is added to the powdery raw material to improve the abrasion resistance and the strength, and those components exist as hard particles in the valve seat.

A lubricant such as zinc stearate or the like for improving a mold releasing property at a time of metal mold forming is added to the powdery raw material to prepare the powdery Fe alloy.

The sintering temperature is 1100 to 1200° C., more preferably 1150 to 1180° C., and the sintering time is 15 to 45 minutes in general.

The tempering treatment is carried out for adjusting a hardness of the sintered Fe alloy obtained and for preventing a change of property at a high temperature. The tempering temperature is 600 to 700° C. in general, and the tempering time is 2 to 3 hours in general.

The thickness ratio of the contacting layer and the main layer is 1 vs. 1 as usual, furthermore, the thickness ratio thereof can be suitably changed by considering the whole strength of the valve seat and the abrasion resistance of the valve seat.

Thus, the valve seat of the present invention has a function to improve the heat conductivity, the strength at a high temperature and the abrasion resistance.

EXAMPLES

Now, the present invention will be described hereinbelow in more detail with reference to Experiment Examples and Comparative Examples.

Experiment Example 1

A powdery raw material (Component No. 1) for forming a contacting layer was so prepared that a powdery C (graphite) of 1.0 wt. %, a powdery Cr of 3.0 wt. %, a powdery Mo of 9.5 wt. % and a powdery electrodeposited Cu having a particle size of up to 150 mesh of 7 wt. % were added to a powdery Fe.

A powdery raw material (Component No. 4) for forming a main layer of a valve seat was so prepared that a powdery C of 1.0 wt. %, a powdery Mo of 0.8 wt. % and a powdery electrodeposited Cu having a particle size of up to 325 mesh of 7 wt. % were added to a powdery Fe.

The component No. 1 of the powdery raw material for forming the contacting layer and the component No. 4 of the powdery raw material for forming the main layer are shown in Table 1.

Zinc stearate of 0.75 wt. % as a lubricating agent for improving the mold releasing property at a time of metal mold forming was added to each powdery raw material to obtain each prepared powdery Fe alloy for sintering.

Two green compact body layers which are formed by both the prepared powdery Fe alloy for forming the contacting layer and the prepared powdery Fe alloy for forming the main layer and is equal in thickness, was subjected to a press forming process at a pressure of 8 ton/cm$^2$ to form a green compact body. After that, a dewaxing treatment was carried out to the green compact body at a temperature of 450° C. for a period of time of 30 minutes, and was sintered at a temperature of 1160° C. for a period of time of 30 minutes to form a sintered body.

The sintered body was tempered at a temperature of 640° C. for a period of time of 2 hours to obtain a test piece of the valve seat of the present invention.

With respect to each test piece obtained, an average density of the two layers which are the contacting layer and the main layer was measured in addition to an amount of abrasion of each test piece and an amount of abrasion of the valve as the object member of the test piece. The results of the tests are shown in Table 2.

TABLE 1

| Component No. | Composition (wt. %) C | Cr | Mo | Cu | Fe | other |
|---|---|---|---|---|---|---|
| 1 For | 1.0 | 3.0 | 9.5 | 7 | Bal. | |
| 2 contacting | 1.0 | 2.5 | 9.0 | 12 | Bal. | |
| 3 layer | 1.0 | 2.0 | 9.0 | 17 | Bal. | |
| 4 For main | 1.0 | — | 0.8 | 7 | Bal. | |
| 5 layer | 1.0 | — | 0.8 | 10 | Bal. | |
| 6 | 1.0 | — | 0.8 | 15 | Bal. | |
| 7 | 1.0 | — | 0.8 | 20 | Bal. | |
| 8 For | 1.0 | 3.0 | 9.0 | — | Bal. | |

TABLE 1-continued

| Component No. | Composition (wt. %) C | Cr | Mo | Cu | Fe | other |
|---|---|---|---|---|---|---|
| 9 contacting | 1.4 | 7.0 | — | — | Bal. | Ni:0.2, Co:6.0 |
| 10 layer | — | — | — | — | — | infiltrating to No.9 |
| 11 For main layer | 1.0 | — | — | — | Bal. | |

NOTE) Bal.: balance is powdery Fe alloy

TABLE 2

| | Component No. For contacting layer | For main layer | Average density of layers (g/cm$^3$) | Amount of abrasion of valve seat (μm) | Amount of abrasion of valve seat (μm) |
|---|---|---|---|---|---|
| Ex-Ex. 1 | 1 | 4 | 7.13 | 23 | 4 |
| Ex-Ex. 2 | 2 | 4 | 7.16 | 28 | 5 |
| Ex-Ex. 3 | 3 | 4 | 7.20 | 29 | 3 |
| Ex-Ex. 4 | 1 | 5 | 7.17 | 20 | 2 |
| Ex-Ex. 5 | 2 | 5 | 7.19 | 24 | 5 |
| Ex-Ex. 6 | 3 | 5 | 7.21 | 30 | 4 |
| Ex-Ex. 7 | 1 | 6 | 7.20 | 31 | 6 |
| Ex-Ex. 8 | 2 | 6 | 7.24 | 30 | 4 |
| Ex-Ex. 9 | 3 | 6 | 7.26 | 35 | 5 |
| Ex-Ex.10 | 1 | 7 | 7.24 | 37 | 5 |
| Ex-Ex.11 | 2 | 7 | 7.27 | 38 | 5 |
| Ex-Ex.12 | 3 | 7 | 7.31 | 45 | 6 |
| Co-Ex. 1 | 8 | 11 | 7.15 | 58 | 12 |
| Co-Ex. 2 | 9 | 11 | 6.95 | 75 | 10 |
| Co-Ex. 3 | 10 | | 7.83 | 33 | 6 |

NOTE) Ex-Ex.: Experiment Example
Co-Ex.: Comparative Example

An amount of abrasion of each test piece and each valve as the object member of each test piece was measured after the abrasion test with the use of the valve seat abrasion testing apparatus as shown in FIG. 1 under the following conditions. In the valve seat abrasion testing apparatus as shown in FIG. 1, a numerical number 10 is a heat source, a numerical number 20 is the valve and a numerical number 30 is the test piece as the valve seat.

Conditions of the abrasion test

Material of valve : SUH-35
Surface temperature of the test piece to which the valve is abutted: 300° C.
Rotation number of cam : 3000 rpm
Rotation number of valve : 20 rpm
Lifting length of valve : 7 mm
Set load : 18.9 kgf (at the time of setting)
38.5 kgf (at the time of lifting)
Testing time : 4.5 hours

Experiment Examples 2 to 12

As other Experiment Examples, a prepared powdery Fe alloy of the component No. 1 to No. 3 as shown in Table 1 for forming a contacting layer and a prepared powdery Fe alloy of the component No. 4 to No. 7 as shown in Table 1 for forming a main layer was used for forming the green compact body with the two layers. In this case, the Cr content of the component No. 1 to No. 3 for forming the contacting layer decreases in the order of from the components No. 1 to No. 3, and the Cu content thereof increases in the order of from the components No. 1 to No. 3, and the Cu content of the components No. 4 to the No. 7 for forming of the main layer increases in the order of from the components No. 4 to No. 7.

The prepared powdery Fe alloy described above was used for the contacting layer and the main layer. A test piece of the valve seat was obtained from the described prepared powdery Fe alloy in the same manner as in the Experiment Example 1. For the test piece obtained, an average density of the two layers which are the contacting layer and the main layer was measured in addition to an amount of abrasion of each test piece and an amount of abrasion of the valve as the object member of the test piece. The results of the tests are shown in Table 2.

Figure 2A:
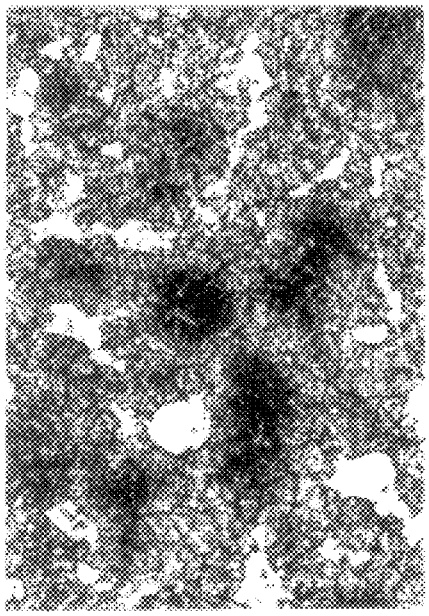
FIG. 2 is a metallographic photograph of a metallurgical structure of a contacting layer(a) and a main layer(b) of a valve seat made of a sintered Fe alloy obtained by Experiment Example 1.
Figure 2B:
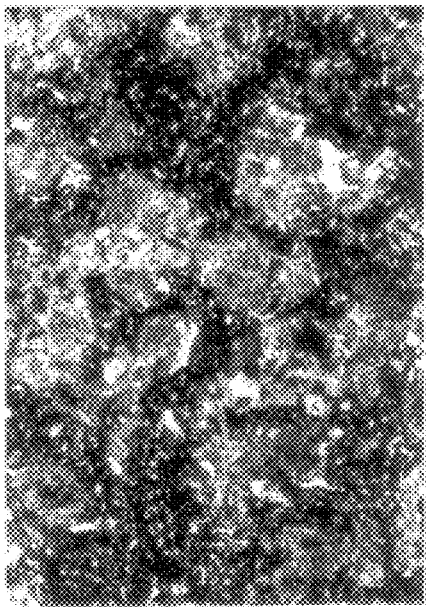
Figure 3A:
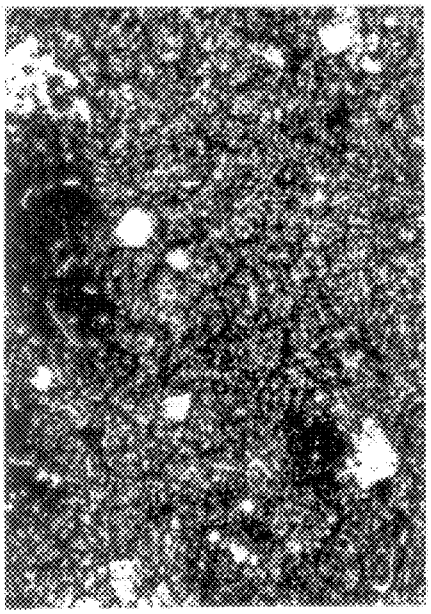
FIG. 3 is a metallographic photograph of a metallurgical structure of a contacting layer(a) and a main layer(b) of a valve seat made of a sintered Fe alloy obtained by Experiment Example 2.
Figure 3B:
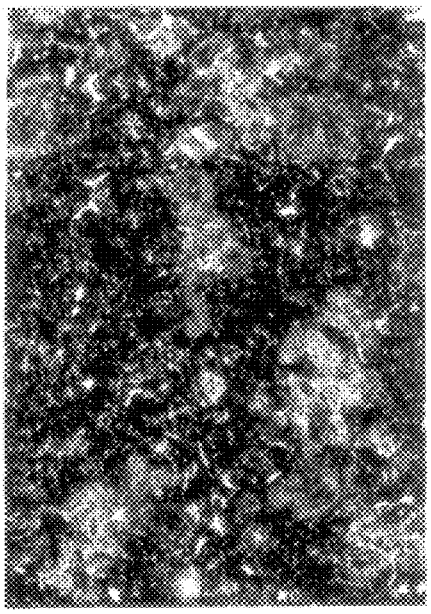
Figure 4A:
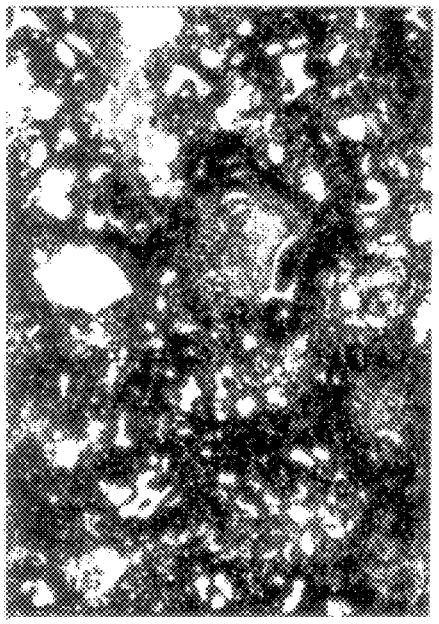
FIG. 4 is a metallographic photograph of a metallurgical structure of a contacting layer(a) and a main layer(b) of a valve seat made of a sintered Fe alloy obtained by Experiment Example 8.
Figure 4B:
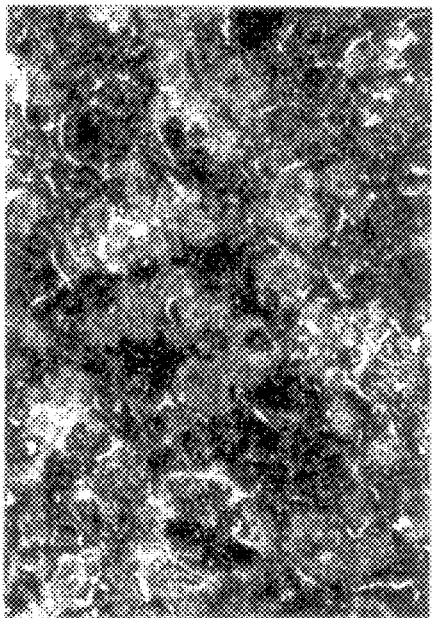
Figure 6:
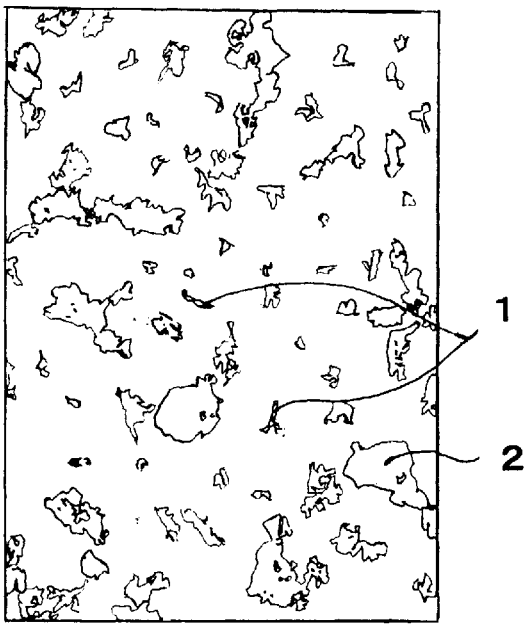
FIG. 6 is a schematic view illustrating the metallurgical structure of the contacting layer(a) and the main layer(b) of the valve seat made of the sintered Fe alloy obtained by Experiment Example 1.
Figure 6:
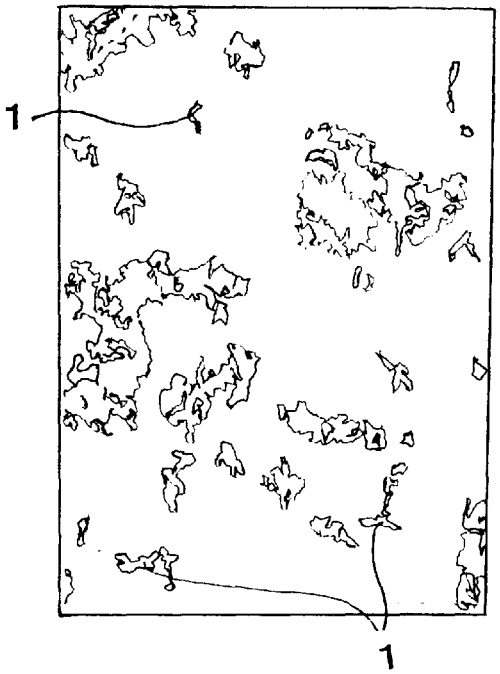
Figure 7:
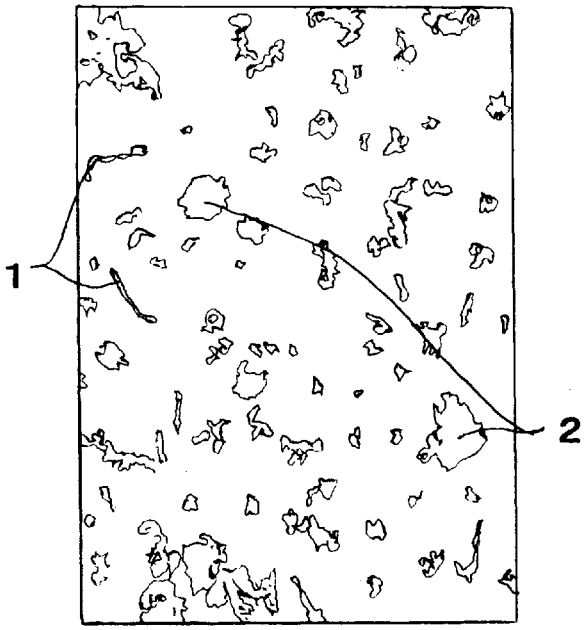
FIG. 7 is a schematic view illustrating the metallurgical structure of the contacting layer(a) and the main layer(b) of the valve seat made of the sintered Fe alloy obtained by Experiment Example 2.
Figure 7:
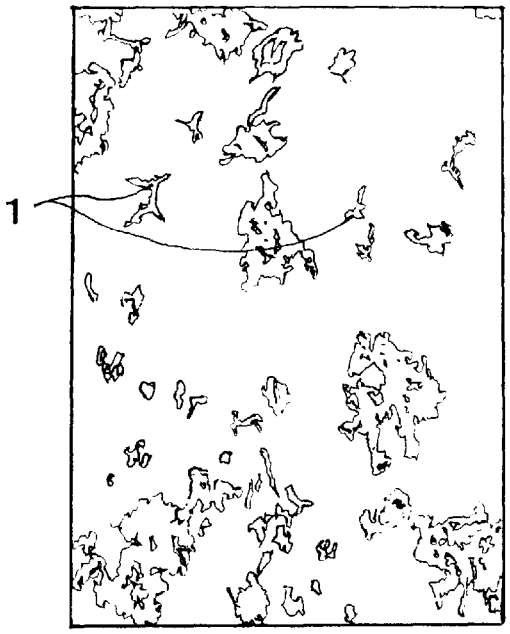
Figure 8:
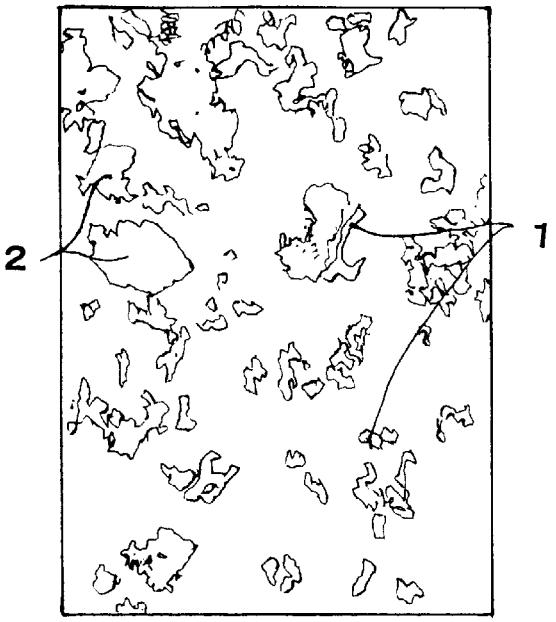
FIG. 8 is a schematic view illustrating the metallurgical structure of the contacting layer(a) and the main layer(b) of the valve seat made of the sintered Fe alloy obtained by Experiment Example 8.
Figure 8:
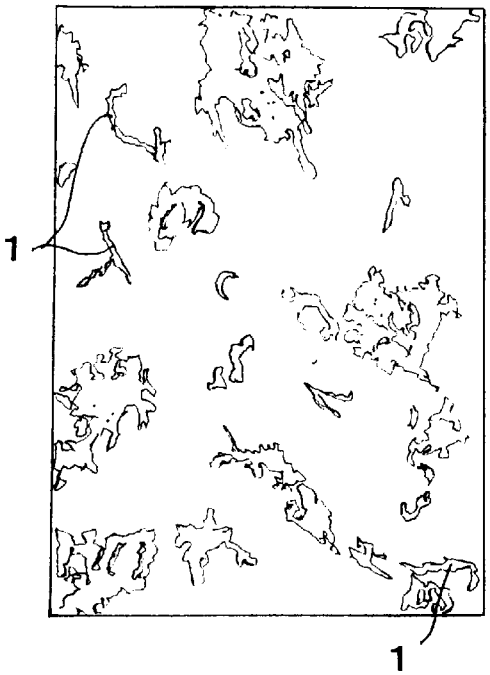

Metallographic photographs (200 magnifications, etched by nital) of the metallurgical structure of the contacting layer and the main layer of the test pieces as the valve seat obtained by Experiment Example 1, Experiment Example 2 and Experiment Example 8 are shown in FIG. 2, FIG. 3 and FIG. 4, respectively. FIG. 6, FIG. 7 and FIG. 8 show metallurgical structures described above, respectively. In the above-mentioned figures, a numerical number 1 is a residual Cu, a numerical number 2 is a hard particle, (a) is metallurgical structure of the contacting layer and (b) is metallurgical structure of the main layer.

Comparative Example 1

A test piece of Comparative Example 1 for a valve seat was prepared in the same manner as in the Experiment Example 1 made of the prepared powdery Fe alloy of the component No. 8 in Table 1 without the Cu component for the contacting layer and the prepared powdery Fe alloy which consists of the powdery C of 1.0 wt. % and the balance being the powdery Fe, and which is the component No. 11 in Table 1 for the main layer. For the test piece obtained, an average density of the two layers which are the contacting layer and the main layer was measured in addition to an amount of abrasion of the test piece and an amount of abrasion of the valve as object member of the test piece in the same manner as in the Experiment Example 1. The results of the tests are shown in Table 2.

Comparative Example 2

A powdery raw material of the component No. 9 for forming the contacting layer was so prepared that a powdery C of 1.4 wt. %, a powdery Ni of 2.0 wt. %, a powdery Co of 6.0 wt. % and a powdery Cr of 7.0 wt. % were added to a powdery Fe. A powdery raw material of the component No. 11 for forming a main layer was so prepared that a powdery C of 1.0 wt. % was added to a powdery Fe.

The lubricating agent was added to obtain each prepared powdery alloy for sintering in the same manner as in the Experiment Example 1.

The prepared powdery Fe alloy was subjected to a press forming process to form a green compact body with the two green compact body layers in the same manner as in the Experiment Example 1. A dewaxing treatment was carried out to the green compact body in the same manner as in the Experiment Example 1, and was sintered at a temperature of 1130° C. for a period of time of 30 minutes to form a sintered body. A test piece of Comparative Example 2 was obtained from the sintered body without the tempering treatment.

For the test piece obtained, tests for a whole density of the two layers which is the contacting layer and the main layer, an amount of abrasion of each test piece and an amount of abrasion of the valve as the object member of the test piece were made. The results of the tests are shown in Table 2.

Comparative Example 3

A test piece of a sintered Fe alloy for a valve seat was prepared in the same manner as in the Comparative Example 2. After that, an infiltration treatment of Cu was carried out to obtain a test piece of Comparative Example 3.

For the test piece obtained, an average density of the two layers which are a contacting layer and a main layer was measured in addition to an amount of abrasion of each test piece and an amount of abrasion of the valve as the object member of the test piece. The results of the tests are shown in Table 2.

Figure 5:
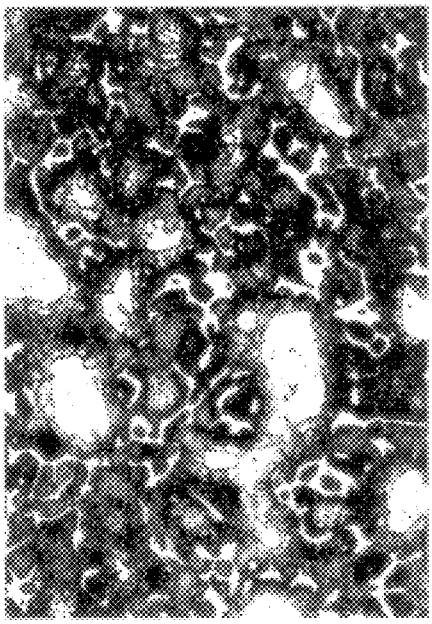
FIG. 5 is a metallographic photograph of a metallurgical structure of a valve seat made of a sintered Fe alloy obtained by Comparative Example 1.
Figure 9:
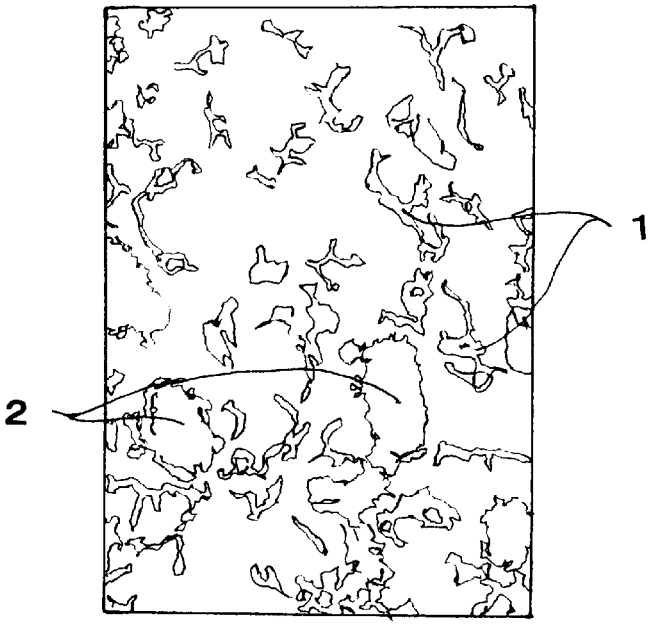
FIG. 9 is a schematic view illustrating the metallurgical structure of the valve seat made of the sintered Fe alloy obtained by Comparative Example 1.

Metallographic photographs (200 magnifications, etched by nital) of the metallurgical structure of the test piece as the valve seat obtained by Comparative Example 3 is shown in FIG. 5. FIG. 9 shows metallurgical structures described above. In the above-mentioned figures, a numerical number 1 is a residual Cu and a numerical number 2 is a hard particle.

Examination of the results

As is clear from Table 2, the amount of abrasion of each test piece and the amount of abrasion of each valve as object member of the test piece according to Experiment Examples 1 to 12 is lower than that of each test piece in which the infiltration treatment of Cu is not performed, and each valve according to Comparative Example 1 to 2 exhibiting a sharp improvement of abrasion resistance. And, each test piece has a high abrasion resistance equivalent to the test piece with the infiltration treatment of Cu of Comparative Example 3.

Therefore, each test piece for each valve seat sintered from the prepared powdery Fe alloy which previously contains the powdery Cu at a particular ratio has a high abrasion resistance equivalent to the test piece obtained from the sintered Fe alloy to which the infiltration treatment of Cu in performed, even if the infiltration treatment of Cu is not performed.

For metallurgical structure of the contacting layer in FIG. 6(*a*), FIG. 7(*a*) and FIG. 8(*a*), the granulated hard particle 2 and the filiform residual Cu 1 uniformly disperses in metallurgical structure of the contacting layer similarly to the conventional valve seat shown in FIG. 9. For metallurgical structures of the main layer in FIG. 6(*b*), FIG. 7(*b*) and FIG. 8(*b*), the filiform residual Cu 1 uniformly disperses in metallurgical structures of the main layer. The main layer is free from vacancy which is generated in course of the infiltration treatment of Cu from the main layer to the contacting layer as generation in the conventional sintering process. Thus, the abrasion resistance and the strength of the contacting layer is equal to that of the conventional valve seat, and moreover, the valve seat obtained of the present invention has a function to improve the strength and the abrasion resistance without the decrease of the strength such as the main layer of the conventional valve seat.

According to the present invention, the prepared powdery Fe alloys previously containing the powdery Cu at a particular ratio for the contacting layer and for the main layer are used, the valve seat formed from the prepared powdery Fe alloys can be obtained without the independent infiltration treatment of Cu after the sintering treatment and has the high abrasion resistance equivalent to the valve seat to which the infiltration treatment of Cu is performed. And, the infiltration of Cu from the main layer to the contacting layer is not generated as the conventional sintering process for manufacturing of the valve seat comprising the two layers without the independent infiltration treatment of Cu, and, therefore, the valve seat obtained of the present invention has the high abrasion resistance without the decrease of the strength of the main layer.

What is claimed is:

1. A process for manufacturing a valve seat composed of a main layer and a contacting layer and made of a sintered Fe alloy, said process comprising the steps of:

(a) adding a powdery Cu or a powdery material containing Cu to powdery Fe to prepare two powdery Fe alloys for forming a green compact body layer to form said contacting layer and the other green compact body layer to form said main layer, wherein one of said powdery Fe alloys for said contacting layer contains 7 to 15 wt. % Cu and the other one of said powdery Fe alloys for said main layer contains 8 to 18 wt. % Cu; wherein a difference of said Cu content between one of said powdery Fe alloys forming said contacting layer and the other one of said powdery Fe alloys forming said main layer is 5 wt. % or below;

(b) forming said powdery Fe alloys into a green compact body composed of said two green compact body layers which respectively constitute said contacting layer and said main layer; and (c) sintering said green compact body.

* * * * *